United States Patent [19]

Frey

[11] 4,421,459

[45] Dec. 20, 1983

[54] FLUID LEVEL CONTROL APPARATUS

[76] Inventor: Ernest Frey, 314 S. 45th W. Ave., Sand Springs, Okla. 74127

[21] Appl. No.: 301,427

[22] Filed: Sep. 11, 1981

[51] Int. Cl.[3] ..... F04B 49/00

[52] U.S. Cl. ..... 417/38; 137/389; 137/391; 417/40

[58] Field of Search ..... 417/36, 38, 40, 18, 417/32; 137/389, 391, 400, 418; 307/118; 73/307-309, 311, 313, 319, 321

[56] References Cited

U.S. PATENT DOCUMENTS

| | | | |
|---|---|---|---|
| 2,941,712 | 6/1960 | Cook | 417/40 X |
| 3,279,380 | 10/1966 | Clark | 417/40 |
| 3,717,421 | 2/1973 | Schaefer | 417/38 |
| 4,001,533 | 1/1977 | Conery et al. | 73/308 X |
| 4,081,638 | 3/1978 | Thorn et al. | 73/308 X |

*Primary Examiner*—Edward K. Look

*Attorney, Agent, or Firm*—Head, Johnson & Stevenson

[57] ABSTRACT

A fluid level control apparatus for a fluid reservoir and comprising a weatherproof housing having a plurality of micro switches mounted therein, the interior of the housing being in communication with the fluid reservoir, a reciprocal rod member extending between the interior of the housing and the fluid reservoir and operably connected with the micro switches for actuation thereof upon reciprocation of the rod, a diaphragm secured to the reciprocal rod and flexible thereby, a helical spring acting against the diaphragm for providing a preselected constant force thereagainst in one direction, a pair of in-line weight members suspended from the reciprocal rod outboard of the diaphragm and calibrated in relation to the physical characteristics of the fluid and force of the spring for counterbalancing of the spring to maintain the diaphragm in a neutral position during normal fluid level conditions within the fluid reservoir, the combined weights of the weight members being variable upon the fluctuation of the fluid level beyond preselected highs and lows for reciprocation of the rod to actuate the micro switches, the micro switches being operably connected with fluid discharge pumping equipment and fluid inlet apparatus to control the supply of fluid to the reservoir and discharge fluid therefrom.

12 Claims, 6 Drawing Figures

FLUID LEVEL CONTROL APPARATUS

BACKGROUND OF THE INVENTION

1. Field of the Invention

This invention relates to improvements in fluid control devices and more particularly, but not by way of limitation, to a fluid level control apparatus.

2. Description of the Prior Art

There are many fluid systems wherein holding tanks, or the like are provided for storage of a supply or reservoir of the fluid. In these installations it is usually necessary or desirable to control both the upper and lower limits of the fluid level within the fluid reservoir. One widely used fluid level control method at the present time is to provide first and second valve control means in communication with the interior of the holding tank, one of the valve controls being responsive to the rising of the fluid level within the tank for stopping the introduction of the fluid thereto, and the other of the valve controls being responsive to the lowering of the fluid level within for stopping the withdrawal of the fluid and reinstating the introduction of the fluid thereto. Another widely used method of fluid level control comprises a float valve, or the like, sensative to relatively small fluctuations in the fluid reservoir for alternately stopping and starting the flow of the fluid thereto in order to maintain a substantially constant level within the tank. These methods have certain disadvantages in that the first mentioned method requires two complete valve assemblies which increases the overall cost of both the initial installation and the maintenance of the equipment. The second mentioned method results in a substantially constant on-off of the pumping equipment and other auxiliary apparatus with the fluctuation of the fluid level which results in considerable wear on the equipment.

Devices have been developed for sensing two different fluid levels within a reservoir, such as that shown in the Thorn et al U.S. Pat. No. 4,031,638, issued Mar. 28, 1978, and entitled "Level Control with Float Actuated Switch." This device includes two float members interconnected to travel together in a manner for activating a switching unit to stop the supply of fluid at a selected high level and to reestablish the supply at a selected low level. The vertical distance between the float members of the Thorn et al control apparatus determines the difference in the pre-selected high and low fluid levels to be monitored thereby, and it is readily apparent that the interconnection between the two float members limits the practical distance which may be established between the two floats. Thus, the frequency of the actuation of the pumping equipment and other auxiliary equipment required for maintaining these two fluid levels exerts undue wear on the equipment.

SUMMARY OF THE INVENTION

The present invention contemplates a novel fluid level control apparatus wherein a single control means is provided for monitoring both a preselected high fluid level and a preselected low fluid level for a fluid reservoir, and which is particularly designed and constructed for overcoming the foregoing disadvantages. The novel control apparatus comprises a plurality of micro switches, or the like, mounted in a weatherproof housing and operably connected with suitable discharge pump means and fluid input source means for actuation thereof in response to preselected fluid levels within the fluid reservoir. A pair of in-line weight members are suspended within the fluid reservoir and operably connected with the micro switches for actuation thereof upon sensing of the preselected high fluid level or low fluid level within the reservoir. In addition, a safety master control micro switch is provided in the housing and adapted for actuation by the movement of one of the float members under fluid level conditions within the fluid reservoir which may occur in an emergency situation, such as upon a breakdown of the auxiliary equipment, or the like. The safety control may shut down the entire fluid supply and discharge system in the event the level of the fluid within the reservoir reaches a preselected emergency elevation therein.

A spring urged diaphragm is interposed between the micro switches and the weight members, the diaphragm having a normal neutral position so long as the fluid level within the reservoir is within the established upper and lower limits and the switches are not activated. When the fluid level within the reservoir falls below the preselected low fluid level, the combined weight of the two weight members suspended from the diaphragm overcomes the force of the spring means whereby the micro switches are activated for supplying additional fluid to the reservoir. When the proper fluid level has been reached in the reservoir the diaphragm returns to the neutral position therefor since the fluid restores the weight balance between the spring means and the weight members. In the event the fluid level rises within the reservoir above the preselected high level the combined weights of the floats lessens because the upper weight will be completely submerged within the fluid. This creates an imbalance condition between the spring and the floats whereby the spring means moves or flexes the diaphragm upwardly which activates the micro switches for shutting down the fluid supply system and activating the fluid discharge system. In the event there is some kind of failure in the switching mechanism, or the like, and the fluid level within the reservoir rises excessively, the pressure of the rising fluid against the under surface of the diaphragm flexes the diaphragm upwardly in a manner for activation of the micro switches for completely shutting down the system. The novel fluid level control means is simple and efficient in operation and economical and durable in construction.

DETAILED DESCRIPTION OF THE PREFERRED EMBODIMENT

Figure 1:
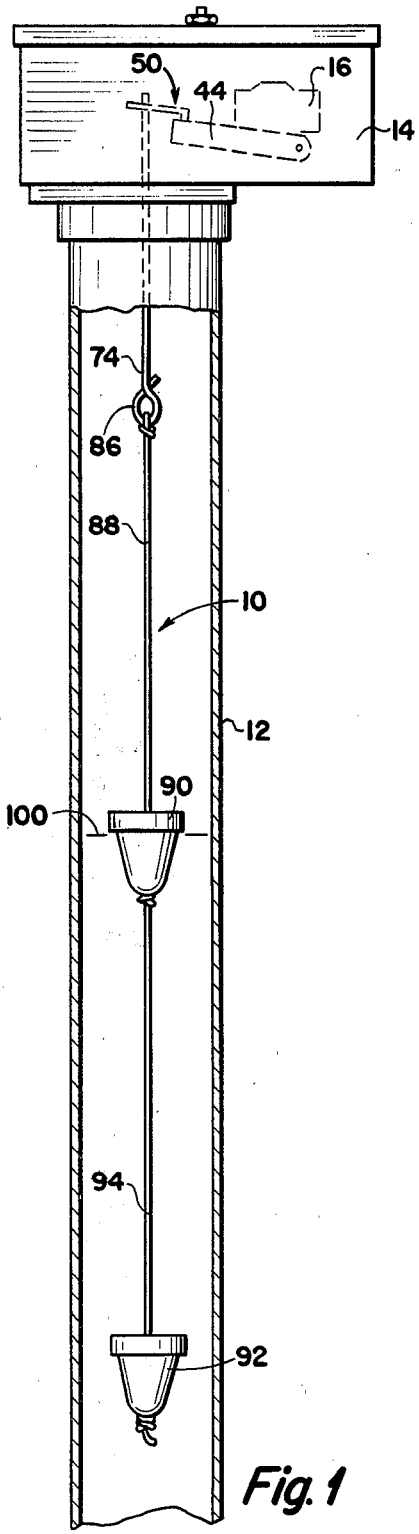
FIG. 1 is an elevational view, partly in section, of a fluid level control apparatus embodying the invention, with portions shown in broken lines for purposes of illustration, and showing one operational position for the apparatus.

Referring to the drawings in detail, reference character 10 generally indicates a fluid level control apparatus adapted for installation within a suitable fluid reservoir such as a standpipe 12 or the like, and comprising a weatherproof housing 14 suitably mounted at the upper end of the pipe or fluid reservoir 12 and having a plurality of micro switches 16, 18 and 20 mounted therein, all of which are operably connected with suitable fluid pumping apparatus (not shown) which supply fluid to the reservoir 12 and withdraw the fluid therefrom as will be hereinafter set forth. The housing 14 may be of any suitable weatherproof construction for protection of the switches 16, 18 and 20 and as shown herein preferably comprises a bottom plate 22 having a sleeve 24 removably secured to the outer surface thereof for receiving the upper end of the pipe 12 therein for facilitating securing of the apparatus 10 thereto. In addition, a port 26 may be provided in the bottom plate 22 for connection with suitable conduit means (not shown) which may be utilized for receiving suitable electrical leads or wiring (not shown) therethrough for connection of the switches 16, 18 and 20 with the exterior pumping apparatus (not shown) or other auxiliary equipment (not shown) utilized in combination with the control apparatus 10. An aperture 26 is also provided in the bottom plate 22 to provide communication between the interior of the housing 10 and the interior of the pipe 12 for a purpose as will be hereinafter set forth.

A suitable peripheral sidewall 28 is provided around the entire outer periphery of the plate 22 and extends substantially perpendicularly outwardly therefrom to provide sidewalls for the housing 12, as is well known. A removable cover member 30 is sealingly engageable with the outer edges of the wall 28 to provide access to the interior of the housing 12 when required and for maintaining the water or weatherproof condition of the housing during normal operating conditions therefor.

Figure 3:
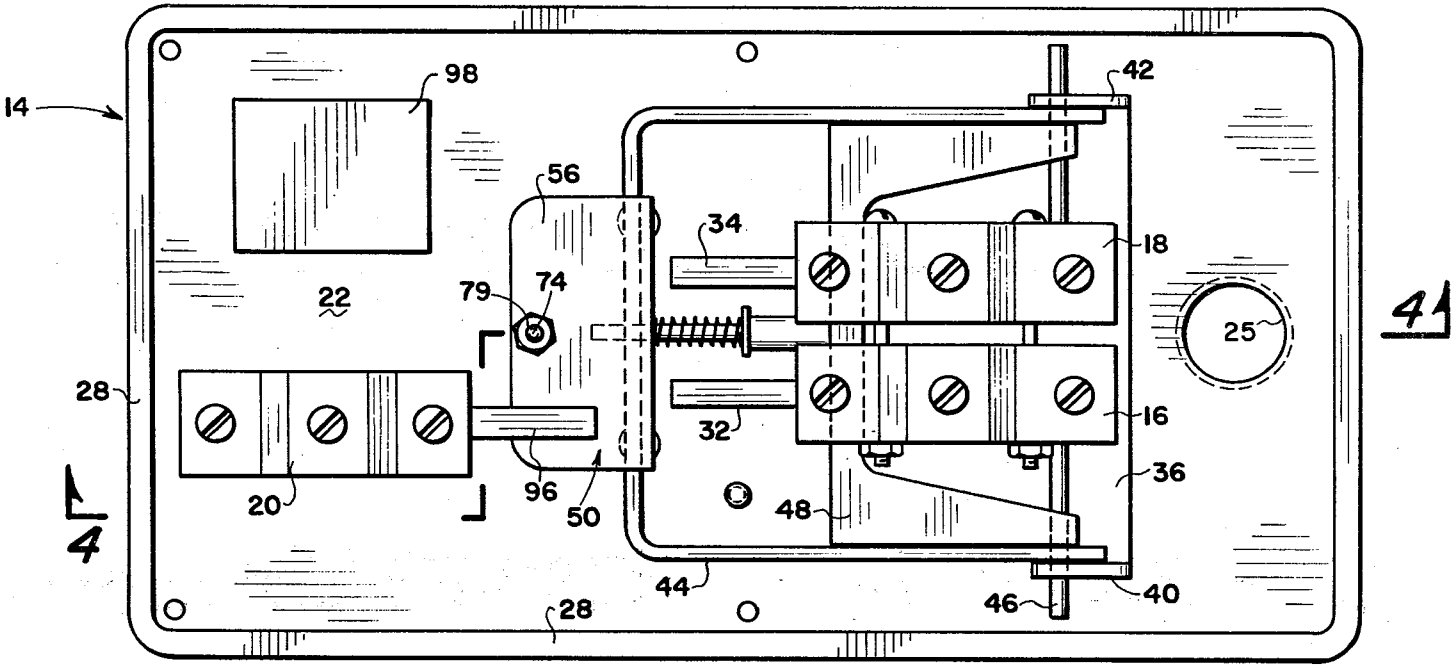
FIG. 3 is a plan view of a fluid level control apparatus embodying the invention.
Figure 4:
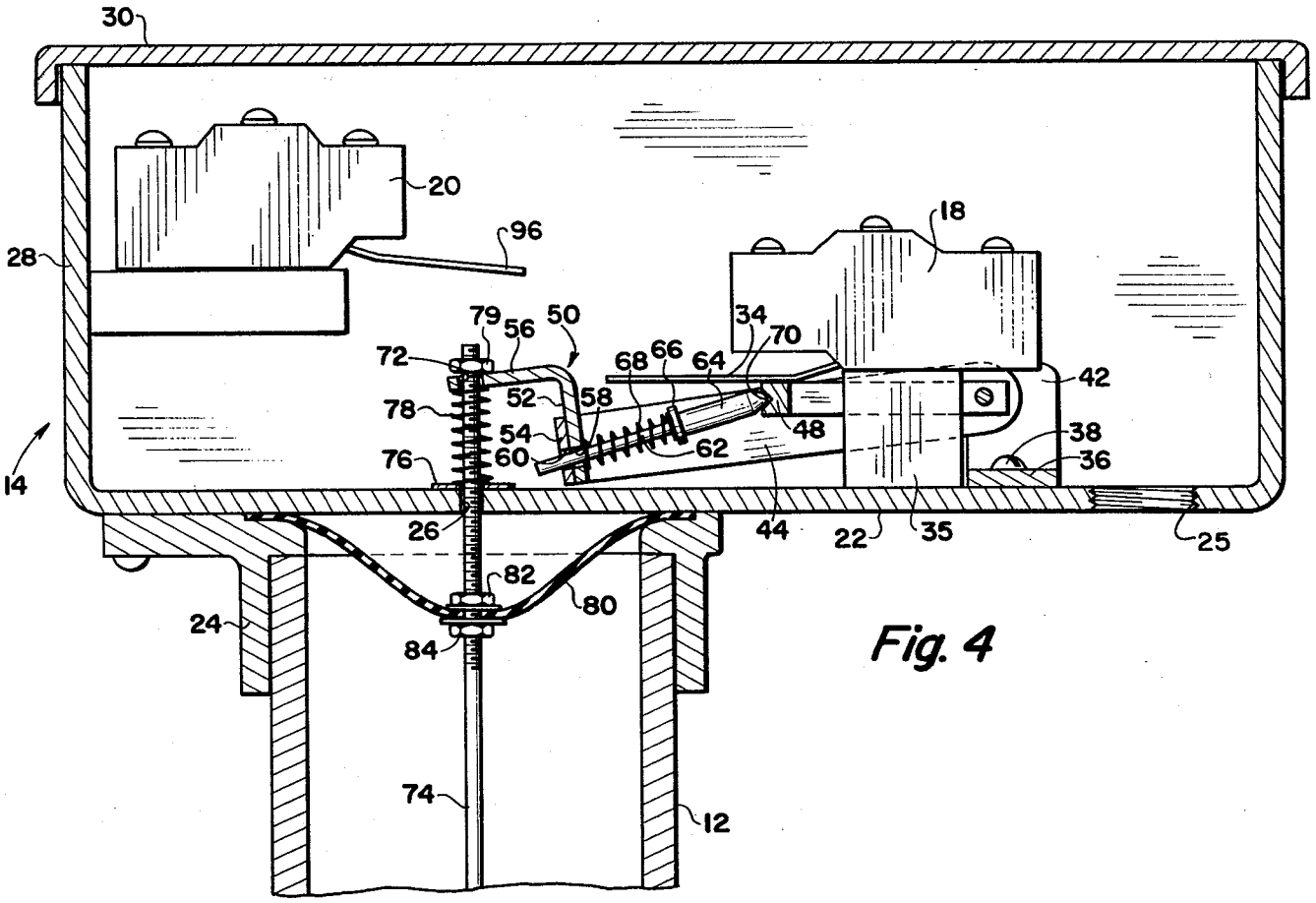
FIG. 4 is a view taken on line 4—4 of FIG. 3.

The micro switches 16 and 18 are preferably disposed in close proximity to one another, as particularly shown in FIG. 3, and arranged in mutually parallel relationship with the actuation levers or arms 32 and 34 thereof, respectively, extending outwardly in a common direction. In addition, the switches 16 and 18 are preferably mounted in spaced relation with respect to the inner surface of the bottom plate 22, and may be mounted on a suitable mounting block means 35, as is well known. A substantially U-shaped bracket 36 may be secured to the plate 22 in any suitable manner, such as by screws 38, with the opposite flanges 40 and 42 thereof being disposed in the proximity of the right hand end of the switches 16 and 18 as viewed in the drawings and spaced outboard thereof as particularly shown in FIG. 3. A U-shaped lever member 44 has the arms thereof disposed between the flanges 40 and 42 and pivotally secured thereby by a pivot shaft 46 extending between and through the flanges 40 and 42. A second substantially U-shaped lever member 48 is disposed inboard of the lever 44 and has the arms thereof pivotally secured between the flanges 40 and 42 by the pivot shaft 46 for pivotal movement independent of the pivotal action of the lever 44.

An L-shaped bracket member 40 has one leg 52 thereof bolted or otherwise secured to the inner face of the bar 54 portion of the lever 44 and the other leg 56 thereof extending substantially perpendicularly outward therefrom in a direction away from the actuating levers 32 and 34 of the switches 16 and 18. The leg 52 and bar 54 are provided with centrally disposed, substantially axially aligned apertures 58 and 60, respectively, for loosely receiving one end of a shank member 62 therethrough. The opposite end of the shank 62 is enlarged to provide a head member 64 for receiving an annular stop member 66 thereagainst and a suitable helical spring 68 is suitably anchored between the outer face of the leg 52 and the stop member 66 for constantly urging the head member 64 in a direction toward the lever 48. The outer end of the head 64 is preferably rounded or substantially pointed for pivotal engagement with a centrally disposed recess or detent 70 provided in the lever 48 for a purpose as will be hereinafter set forth.

The leg 56 of the bracket 50 is provided with an aperture 72 centrally disposed in the proximity of the outer edge thereof for slidably receiving the inner end of a rod member 74 therethrough. The inner end of the rod 74 is preferably threaded and extends through the aperture 26 provided in the plate 22 and into the interior of the pipe 12. An annular stop plate 76 is preferably against the inner surface of the plate 22 surrounding the aperture 26 and a suitable helical spring 78 is suitably anchored between the plate 76 and the leg 56 of the bracket 50 for constantly urging the outer end of the rod 74 upwardly as viewed in the drawings. An adjustable nut 79 is threadedly secured to the inner end of the rod 74 outboard of the leg 56 of the bracket for adjusting the compression or force of the spring 78. A flexible diaphragm 80 is disposed around the outer periphery of the rod 74 outboard of the plate 22 and has the outer periphery thereof anchored between the sleeve 24 and outer surface of the plate 22. Stop nut members 82 and 84 are threadedly secured to the rod 74 on the opposite sides of the diaphragm 80 for securing the diaphragm to the rod 74 for movement simultaneously therewith, as will be hereinafter set forth.

Figure 2:
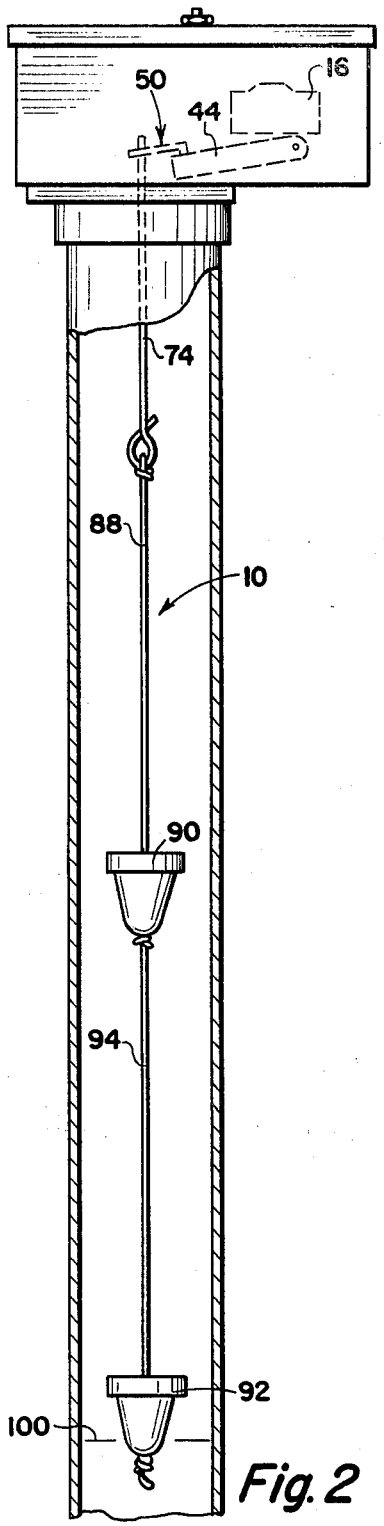
FIG. 2 is a view similar to FIG. 1 illustrating another operational position for the apparatus.

The rod 74 is preferably of a longitudinally rigid construction, and the outer end thereof may be provided with an open eye or loop 86 for connection with one end of a rope, cord, cable, or the like, 88 which may be suspended within the pipe 12 from the outer end of the rod 74, as particularly shown in FIGS. 1 and 2. A first weight member 90 is suitably secured at the outer end of the rope or cable 88, and a second weight member 92 is suspended within the pipe 12 from the weight 90 by a second rope, cord, cable, or the like 94. The weight members 90 and 92 are of matched weights in accordance with the fluid in the fluid reservoir 12 being monitored by the apparatus 10. In addition, it is preferable that the cords or ropes 88 and 94 be constructed from nylon, or the like, which resists rot and rust, and the micro switches 16, 18 and 20 are preferably enclosed switches thus providing a prolonged useful life for the apparatus 10 with a minimum of down-time for repair and maintenance.

The micro switch 20 may be mounted within the housing 12 in any suitable manner (not shown) in spaced off-set relation with respect to the switches 16 and 18, with the actuator lever 96 thereof disposed in a position above the levers 32 and 34 as viewed in the drawings and extending in a direction toward the switches 16 and 18. In addition, it is preferable to provide a suitable thermostat or temperature sensor device 98 in the housing 12, said sensor 98 being operably connected with the pumping apparatus (not shown) and other auxiliary equipment (not shown) for control thereof in response to excessively high or low temperature conditions within the housing 12, as is well known.

In operation, the normal or neutral position for the diaphragm is substantially horizontal, as viewed in the drawings, and the spring 78 functions for maintaining the diaphragm in the neutral position as long as the fluid level 100 within the reservoir 12 is prefered or selected elevational limit established for the system. In this position, the rod 74 is in the normal or neutral position therefor. The pivotal lever 44 will be in a substantially horizontal position therefor and the pivotal lever 48 will also be in a substantially horizontal position due to the engagement of the head member 64 therewith. The levers 32 and 33 will be in the central position therefor and the switches 16 and 18 will be in the normal operating position therefor and the fluid system may function under its normal operating conditions. The combined weights of the weight members 90 and 92 are selected to substantially exactly counterbalance the force of the spring 78 when the fluid level is at the desired or normal operating level for the fluid system being monitored.

As the fluid level falls within the reservoir 12, the uppermost or first weight 90 increases in weight as it is more and more exposed with respect to the fluid. As the fluid level reaches the preselected minimum level therefor, a sufficient part of the lowermost or second weight member 92 will also be exposed as shown in FIG. 2, and at the selected low level limit, the combined weights of the weights 90 and 92 will overcome the force of the spring 78 for moving the pivotal lever 44 downwardly whereby the engagement of the head 64 with the pivotal lever 48 will move upward and engage the actuator arms 32 and 34 of the switches 16 and 18. This activates the switches for initiating the operation of fluid inlet apparatus and for stopping the action of the fluid discharge pumping apparatus whereby the fluid level in the reservoir 12 may be restored to the desirable normal conditions therefor.

When the fluid level 100 within the reservoir 12 rises above the preselected high level limit therefor, both the weights 90 and 92 will be completely submerged in the fluid, and the effective weight acting downwardly against the force of the spring 78 will be lessened whereby the spring moves the rod 74 upwardly as viewed in the drawings. This moves the arm 44 upwardly and the arm 48 downwardly whereby the lever members 32 and 34 may move downwardly to activate the respective switches 16 and 18 for stopping the action of the fluid supply equipment (not shown) and initiating the action of the fluid discharge pumping equipment (not shown). Of course, as the fluid level in the reservoir 12 drops to the preselected normal operating level for the fluid system, the force of the spring 78 will be counterbalanced by the combined effective weights of the weights 90 and 92 and the diaphragm will return to the horizontal or neutral position therefor to replace the switches 16 and 18 in the neutral operational condition as hereinbefore set forth.

Figure 6:
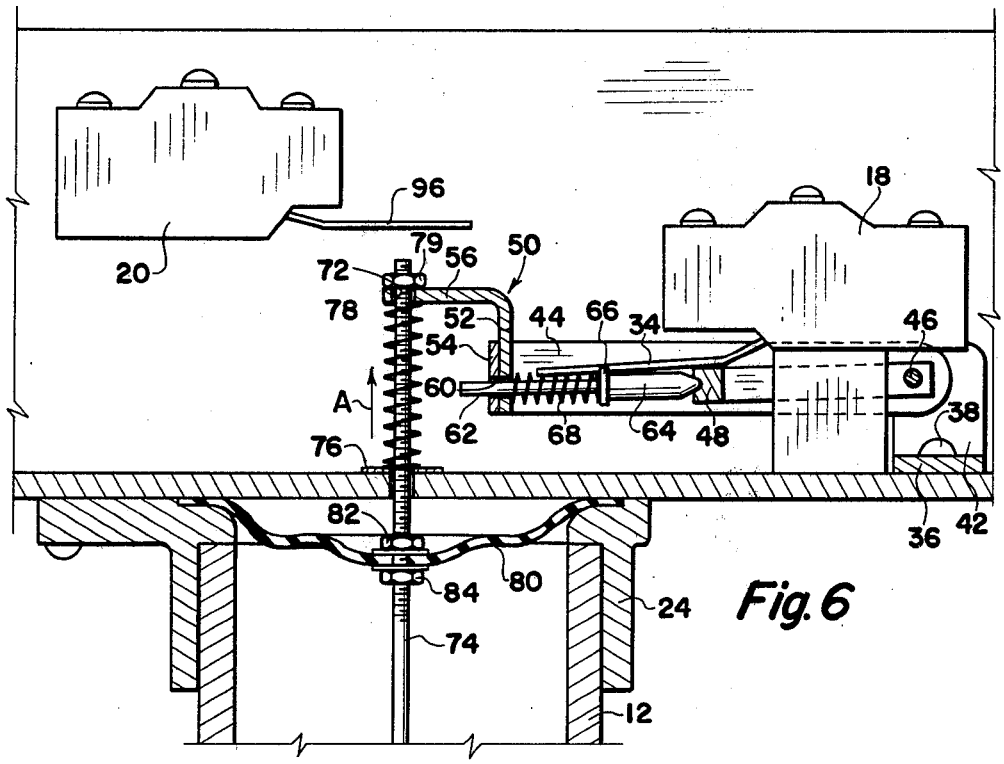
FIG. 6 is a view similar to FIG. 5 illustrating another position for actuation of the switching portion.

The position of the rod 74 as depicted in FIG. 6 is the "breaks over center" position during the upward travel of the rod, as indicated by the arrow. This lock-over center position stops the back and forth pulsing of motors (not shown) and pumping equipment (not shown) which saves wear on the entire system, making operation and maintenance more economical.

Figure 5:
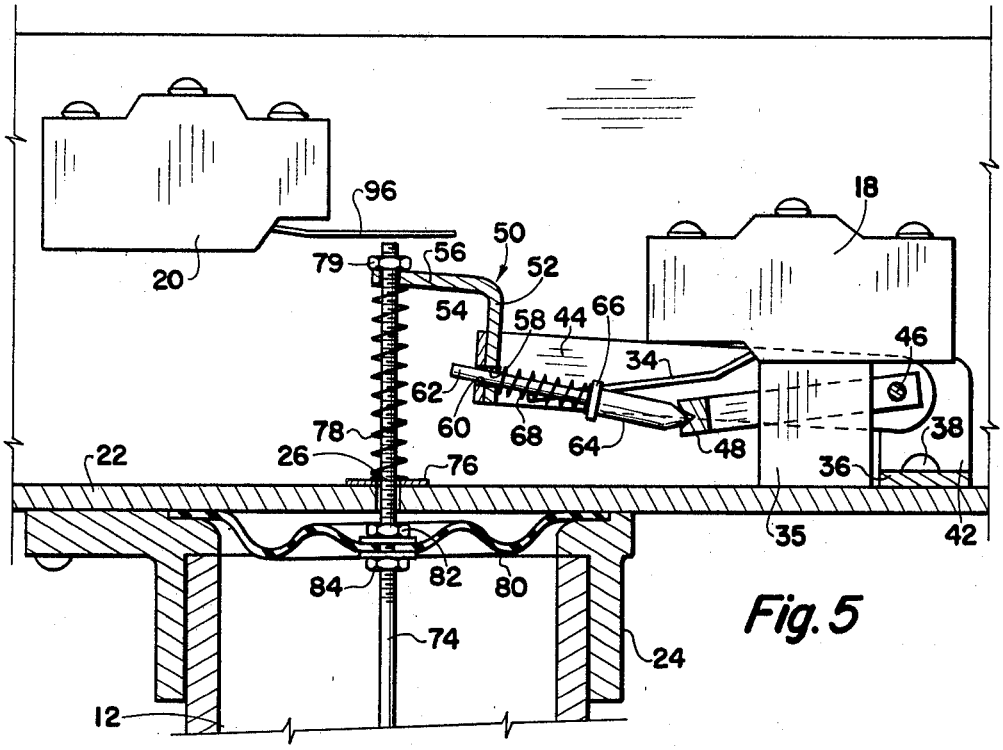
FIG. 5 is a sectional elevational view of the switching portion of a fluid level control apparatus embodying the invention illustrating one position for actuation of the switching portion.

In the event a malfunction in the overall fluid system occurs, and the fluid level within the reservoir 12 continues to rise regardless of the foregoing operation of the apparatus 10, the fluid level within the resevoir will rise until it ultimately engages the under surface of the diaphragm 80. The force of the rising fluid against the diaphragm will overcome the force of the spring 78. As the fluid level continues to rise, the diaphragm 80 will be flexed upwardly for moving the rod 74 upwardly, as particularly shown in FIG. 5. The outer end of the rod 74 will engage the lever 96 of the switch 20 for activation of the switch 20 to completely shut down the entire fluid system thus precluding damage from an overflow of the fluid from the reservoir 12.

Of course, the thermostat or temperature sensor 98 within the housing 12 functions for shutting down the entire fluid system in the event of excessive high or low temperature conditions within the housing 12, and reestablishing the operation of the system upon a return to normal temperature limits therein for protection of the entire fluid system, as is well known.

From the foregoing it will be apparent that the present invention provides a novel single fluid level control device for monitoring both the high and low fluid level limits within a fluid reservoir. The high and low fluid level limits may be preselected at a substantial elevational difference in order to reduce the frequency of actuation of the fluid handling apparatus associated with the fluid system. A pair of matching or calibrated in-line weights are suspended within the fluid reservoir and operably connected with suitable micro switches which control both the supply and discharge of the fluid to and from the reservoir. The fluid reservoir may be open or closed top tanks, well, dams, and the like, and the mounting may be varied in accordance with the required installation environment, and is particularly designed for installation in the most convenient location for facilitating connection of the internal switches to the electrical line and load conductors.

Whereas the present invention has been described in particular relation to the drawings attached hereto, it should be understood that other and further modifications, apart from those shown or suggested herein may be made within the spirit and scope of this invention.

What is claimed is:

1. Fluid level control apparatus for a fluid reservoir and comprising switching means, calibrated weight means operably connected with the switching means and suspended within the fluid reservoir, pressure sensing means interposed between the weight means and the switching means and responsive to the effective weight variances of the weight means resulting from fluid level differentials for activation of the switching means for selective actuation of a fluid input source and a discharge pump means for alternately stopping the flow of fluid to the reservoir and simultaneously discharging fluid therefrom and initiating the addition of fluid to the reservoir depending upon the fluid level within the reservoir, wherein the switching means comprises a pair of associated micro switches, first pivotal lever means disposed in the proximity of the associated micro switches, second pivotal lever means secured inboard of the first pivotal lever means and engageable with the associated micro switches for actuation thereof, bracket means connected between the first pivotal lever means and the pressure sensing means for pivoting of the first pivotal lever means in response to fluid level fluctuations, and connecting means secured between the first and second pivotal lever means whereby pivoting of the first pivotal lever means transmits pivoting to the second pivotal lever means for actuation of the associated switches.

2. Fluid level control apparatus as set forth in claim 1 and including weatherproof housing means encasing the switching means.

3. Fluid level control apparatus as set forth in claim 1 wherein the calibrated weight means comprises a pair of matched in-line weight members suspended within the fluid reservoir.

4. Fluid level control apparatus as set forth in claim 1 wherein the pressure sensing means comprises a flexible diaphragm having one side thereof open to the fluid reservoir, and adjustable helical spring means imposing a preselected force against the diaphragm counter to the weight of the weight means.

5. Fluid level control apparatus as set forth in claim 4 wherein the weight means comprises a pair of in-line weight members suspended in the fluid reservoir and connected with the diaphragm, said weight members being calibrated with relation to the fluid and force of the spring for actuation of the switching means in response to fluctuations of the fluid level in the reservoir.

6. Fluid level control apparatus as set forth in claim 1 wherein the switching means includes a third micro switch disposed in spaced relation with respect to the associated switches for actuation by the pressure sensing means upon emergency conditions for stopping the flow of fluid to the reservoir.

7. A fluid level control apparatus for a fluid reservoir and comprising housing means having the interior thereof in communication with the fluid reservoir, switching means mounted within the housing means, reciprocal rod means extending between the interior of the housing and the fluid reservoir, switch actuator means interposed between the reciprocal rod means and the switching means, flexible diaphragm means secured to the reciprocal rod means and flexible upon reciprocation thereof, adjustable spring means interposed between the diaphragm means and switch actuator means for applying a preselected constant force against the diaphragm means, weight means suspended from the reciprocal rod means and disposed outboard of the diaphragm means, said weight means being calibrated in accordance with the physical characteristics of the fluid and force of the adjustable spring means whereby the switch actuator means is actuated in response to the fluid level within the fluid reservoir for monitoring the fluid level conditions, and including second switching means operably connected to a fluid inlet source and disposed within the housing in spaced relation with respect to the first mentioned switching means and engagable by the reciprocal rod means under emergency conditions to cease the operation of the fluid inlet source for stopping the supply of fluid to the fluid reservoir.

8. A fluid level control apparatus as set forth in claim 7 wherein the weight means comprises a pair of in-line matched weight members disposed in preselected spaced relationship.

9. A fluid level control apparatus as set forth in claim 8 wherein the spacing between the weight members coincides with the preselected high and low fluid limits within the fluid reservoir.

10. A fluid level control apparatus as set forth in claim 7 wherein the first mentioned switching means comprises two associated micro switches, and the second switching means comprises a single micro switch.

11. A fluid level control apparatus for a fluid reservoir and comprising housing means having the interior thereof in communication with the fluid reservoir, switching means mounted within the housing means, reciprocal rod means extending between the interior of the housing and the fluid reservoir, switch actuator means interposed between the reciprocal rod means and the switching means, flexible diaphragm means secured to the reciprocal rod means and flexible upon reciprocation thereof, adjustable spring means interposed between the diaphragm means and switch actuator means interposed between the diaphragm means and switch actuator means for applying a preselected constant force against the diaphragm means, weight means suspended from the reciprocal rod means and disposed outboard of the diaphragm means, said weight means being calibrated in accordance with the physical characteristics of the fluid and force of the adjustable spring means whereby the switch actuator means is actuated in response to the fluid level with the fluid reservoir for monitoring the fluid level conditions, and wherein the switch actuator means comprises a first pivotal arm means secured in the proximity of the switching means, second pivotal arm means secured inboard of the first pivotal arm means and selectively engagable with the switching means for actuation thereof, and connecting means interposed between the first and second pivotal arm means for transmitting movement therebetween.

12. A fluid level control apparatus as set forth in claim 11 and including connector bracket means secured between the first pivotal arm means and the reciprocal rod means whereby the first pivotal arm means is activated in response to the reciprocation of the reciprocal rod means.

* * * * *